US009921018B2

(12) United States Patent
Osann, Jr.

(10) Patent No.: US 9,921,018 B2
(45) Date of Patent: Mar. 20, 2018

(54) MULTI-MODE WEAPON

(71) Applicant: Robert Osann, Jr., Port Angeles, WA (US)

(72) Inventor: Robert Osann, Jr., Port Angeles, WA (US)

( * ) Notice: Subject to any disclaimer, the term of this patent is extended or adjusted under 35 U.S.C. 154(b) by 0 days.

(21) Appl. No.: 14/956,232

(22) Filed: Dec. 1, 2015

(65) Prior Publication Data

US 2017/0067710 A1 Mar. 9, 2017

Related U.S. Application Data

(60) Provisional application No. 62/086,573, filed on Dec. 2, 2014.

(51) Int. Cl.

| | |
|---|---|
| ***F41A 9/53*** | (2006.01) |
| ***F41A 19/16*** | (2006.01) |
| ***F41H 9/10*** | (2006.01) |

(52) U.S. Cl.

CPC ..... *F41A 19/16* (2013.01); *F41H 9/10* (2013.01)

(58) Field of Classification Search

CPC ..... F41A 19/16; F41H 9/10
USPC ..... 42/1.01
See application file for complete search history.

(56) References Cited

U.S. PATENT DOCUMENTS

| | | | | |
|---|---|---|---|---|
| 4,316,338 A * | 2/1982 | Mason | F41C 23/10 | 222/79 |
| 5,671,559 A * | 9/1997 | Ludaesher | F41B 9/00 | 222/79 |
| 9,534,858 B2 * | 1/2017 | Forbes | F42B 5/08 | |

* cited by examiner

*Primary Examiner* — Samir Abdosh

(57) ABSTRACT

A multi-mode and/or multi-ammunition weapon is described, whereupon being removed from a stored position is always initially in a first mode that is intended to disable or stun a subject. If deadly force is required, the weapon is easily and quickly placed in a second mode that is deadly. When returned to the stored position, the weapon is automatically placed in the first mode. Different mechanisms for disabling and/or stunning a subject are also described. A mechanism is optionally included for recording sequences of attack modes and/or ammunition types fired to provide an un-alterable record of events when the weapon is fired.

13 Claims, 3 Drawing Sheets

MULTI-MODE WEAPON

CROSS-REFERENCE TO RELATED APPLICATIONS

The present application claims priority to and incorporates by reference U.S. Provisional Application No. 62/086,573, by inventor Robert Osann, Jr., filed on Dec. 2, 2014, entitled "Multi-Mode Weapon" and commonly assigned with the present application.

TECHNICAL FIELD

The present invention relates generally to firearms, and more specifically to different forms of weapons used by law enforcement officers.

BACKGROUND

There are times when law enforcement officers use deadly force on unarmed or minimally-armed persons. A weapon is needed that can disable a suspect without using deadly force, while still allowing deadly force when necessary. In particular, a weapon is needed that when stored on a user's person is consistently placed in an initial mode for "stun" or "disable", but can be easily and quickly changed to "deadly". Making sure the weapon always starts in the disable setting is important since otherwise many officers may choose to leave a multi-mode weapon in the deadly mode. Therefore, a solution that ensures a weapon always starts out in disable mode is needed. Also needed for a multi-ammunition weapon is an integral recording function wherein for each shot fired, the recording function records what type of ammunition was expended for each shot fired of a sequence of shots, and wherein resetting of the recording function is under control of persons other than an assigned user of the weapon.

DETAILED DESCRIPTION

A multi-mode and/or multi-ammunition weapon is described, whereupon being removed from a stored position is always initially in a first mode that is intended to disable or stun a subject. If deadly force is required, the weapon is easily and quickly placed in a second mode that is deadly. When returned to the stored position, the weapon is automatically placed in the first mode. Different mechanisms for disabling and/or stunning a subject are also described. Two modes of attack mechanism are a minimum configuration for a multi-Mode Weapon according to the invention, and additional modes of attack mechanism are possible within the scope of the invention.

A multi-mode weapon is a weapon which comprises at least two distinctly different attack modes or mechanisms, and may include a capability to discharge at least two forms of ammunition. For a preferred embodiment according to the invention, at least one attack mode has a low probability of being deadly, however for other embodiments, two or more modes of attack for a multi-mode weapon may all be deadly, or may all be non-deadly.

A holster according to the invention is any device in which a weapon may be stored.

An integral selection mechanism is any mechanism—including a mechanical mechanism, an electronically controlled mechanism, or a combination of the two—that selects a specific attack mechanism from two or more possible attack mechanisms.

A selection activation device is any device on the external surface of the multi-mode weapon that causes the multi-mode weapon to change attack modes and/or ammunition types.

Figure 1A:
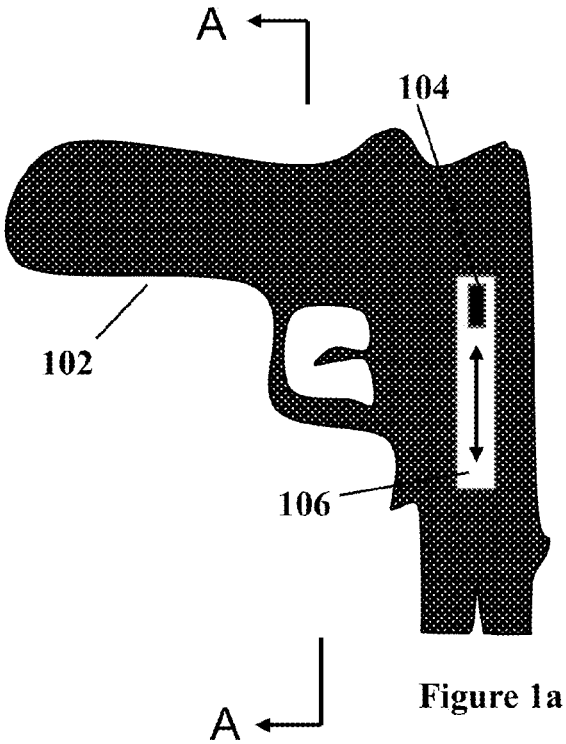
FIG. 1A shows an exemplary and non-limiting side-view.
Figure 1B:
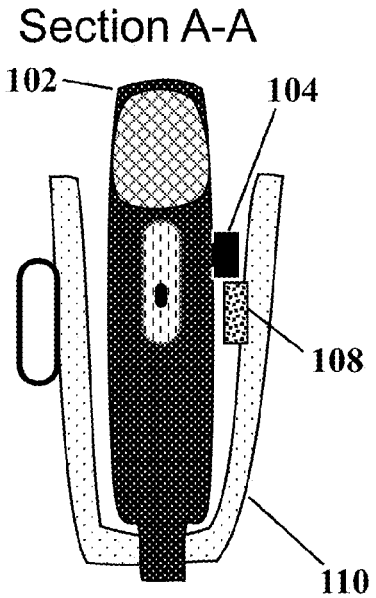
FIG. 1B shows a corresponding cross section view of a weapon according to the invention wherein an integral selection mechanism for placing the weapon in a non-deadly mode upon insertion into a holster is a slider mechanism, and the slider mechanism is shown in a first position that selects the non-deadly mode.
Figure 2:
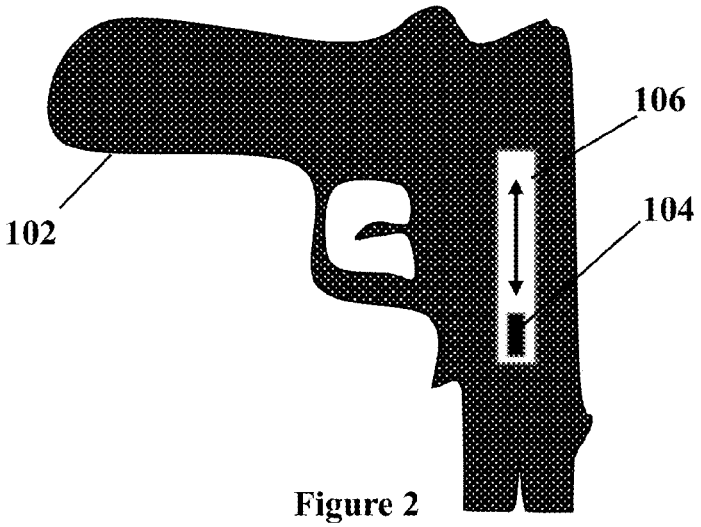
FIG. 2 shows the weapon of FIGS. 1A and 1B where the slider mechanism is shown in a second position that selects a deadly mode.

FIG. 1A shows a side view of an exemplary and non-limiting multi-mode weapon that includes an integral selection mechanism 106 that chooses a first or second mode, the first mode being the mode that is intended to have a high probability of disabling or stunning a subject with a low probability of being deadly, and the second mode having a high probability of being deadly. According to the embodiment of FIG. 1A, integral selection mechanism 106 comprises a slider mechanism 104 that is positioned in a longitudinal direction that is parallel to the firing direction of the weapon, and where the slider mechanism controls at least in part the current attack mode of the multi-mode weapon. FIG. 1B shows a cross-section view A-A of the weapon of FIG. 1A where multi-mode weapon 102 has been inserted into holster 110, and where upon such insertion slider mechanism 104 engages with selection activation device 108 in order to cause slider mechanism 104 to slide to a first position as shown in FIG. 1A thereby placing multi-mode weapon 102 in the first mode. Thus, regardless of the position of slider mechanism 104 when weapon 102 is not stored in holster 110, upon inserting weapon 102 in holster 110, weapon 102 will always be placed in the first mode. FIG. 2 shows slider mechanism 104 having been moved to a second position where the second position places the weapon in the second mode which is intended to be deadly. Note that if a police office or other user is in mortal danger at the time they draw weapon 102 from holster 110, they may reach across with their opposite hand and grasp slider mechanism 104 in order to move slider mechanism 104 into the second position as shown in FIG. 2 simultaneously with drawing the weapon. Thus, a police officer or user may exercise deadly force from the beginning of an incident.

Figure 3A:
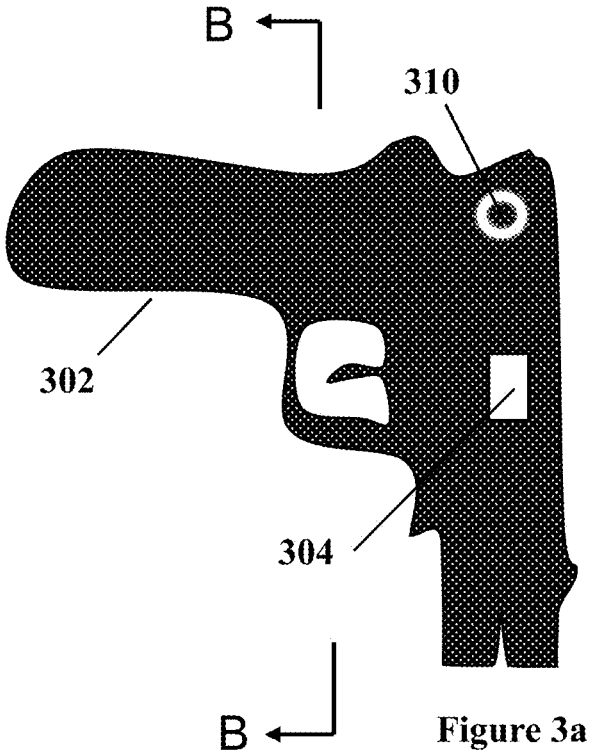
FIG. 3A shows an exemplary and non-limiting side-view.
Figure 3B:
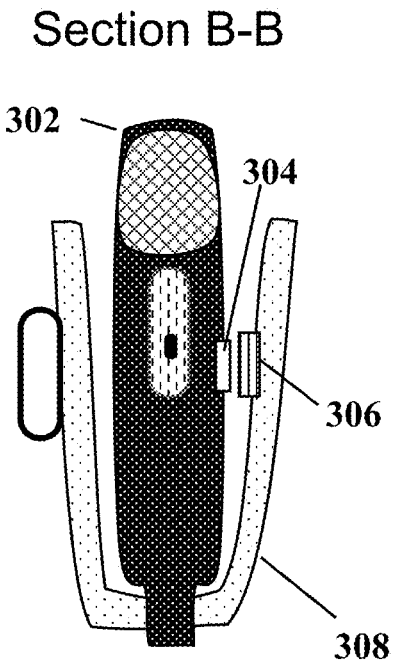
FIG. 3B shows a corresponding cross section view of a weapon according to the invention where an integral selection mechanism for placing the weapon in a non-deadly mode upon insertion into a holster is controlled by an electronically controlled proximity sensing mechanism.
Figure 4:
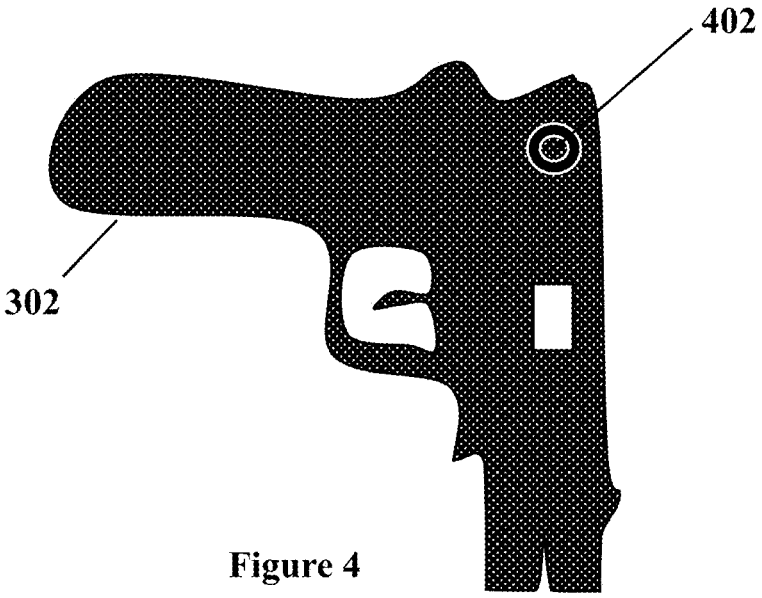
FIG. 4 shows the weapon of FIGS. 3A and 3B where a user has activated a deadly mode by activating a switch or button.

FIGS. 3A and 3B show an alternative embodiment for a multi-mode weapon whereby the integral selection mechanism comprises electronic sensing and control. Here multi-mode weapon 302 includes integral selection mechanism 304 which comprises some form of proximity sensing device such as for example and without limitation a Hall-effect device or simply a conductive coil that is sensitive to magnetic effects. Also shown on the side view of weapon 302 in FIG. 3A is a button or switch 310 which is used to set or toggle the multimode weapon between at least first and second modes where the first mode is intended to have a high probability of disabling or stunning a subject with a low probability of being deadly, and the second mode having a high probability of being deadly. Cross-section B-B shown in FIG. 3B shows weapon 302 placed in holster 308, where holster 308 includes selection activation device 306 which interacts with integral selection mechanism 304 when the two are in close proximity, thereby causing weapon 302 to be placed in the first mode. FIG. 4 shows weapon 302 placed in the second mode which is deadly, after the second mode has been activated by a police officer or user by activating switch or button device 310, shown in FIG. 4 as switch or button device 402 where the appearance or structure of device 402 has optionally been changed when the attack mode is changed.

Figure 5:
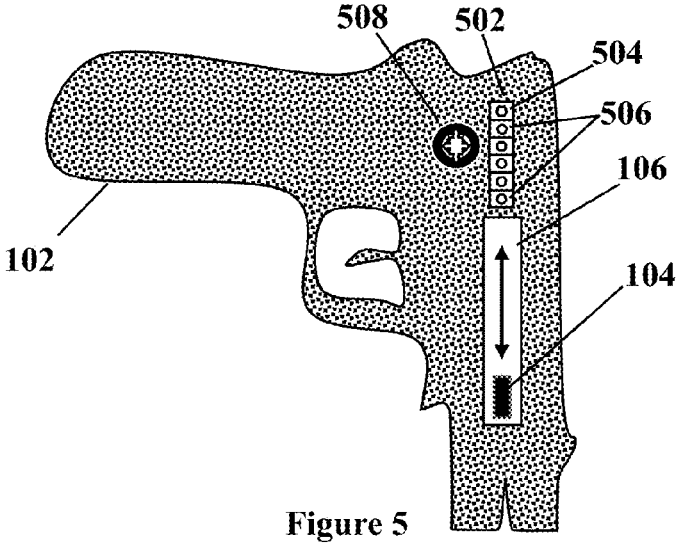
FIG. 5 shows a multimode, multi-ammunition weapon including a $1^{st}$ embodiment for recording which form of attack mechanism and/or ammunition was utilized for each shot fired of a sequence of shots, and wherein resetting of the recording function is under control of persons other than an assigned user of the weapon.

The multimode weapon of FIGS. 1 and 2 may optionally further comprise a recording function wherein for each shot fired, the recording function records which of the first and second modes (forms of attack mechanism) are utilized for each shot fired of a sequence of shots, and wherein resetting of the recording function is under control of persons other than an assigned user of the weapon. One embodiment for such a configuration is shown in FIG. 5 wherein a cluster comprising a plurality of indicator positions 502 is shown including a $1^{st}$ indicator position 504 that shows the type of attack mechanism fired for a first shot of a sequence of shots, and subsequent indicator positions 506 that record and show in sequence types of attack mechanisms fired for each shot fired subsequent to $1^{st}$ shot 504. Also shown is a key lock mechanism 508 that provides for resetting the recording function under control of persons other than an assigned user of the weapon.

Figure 6:
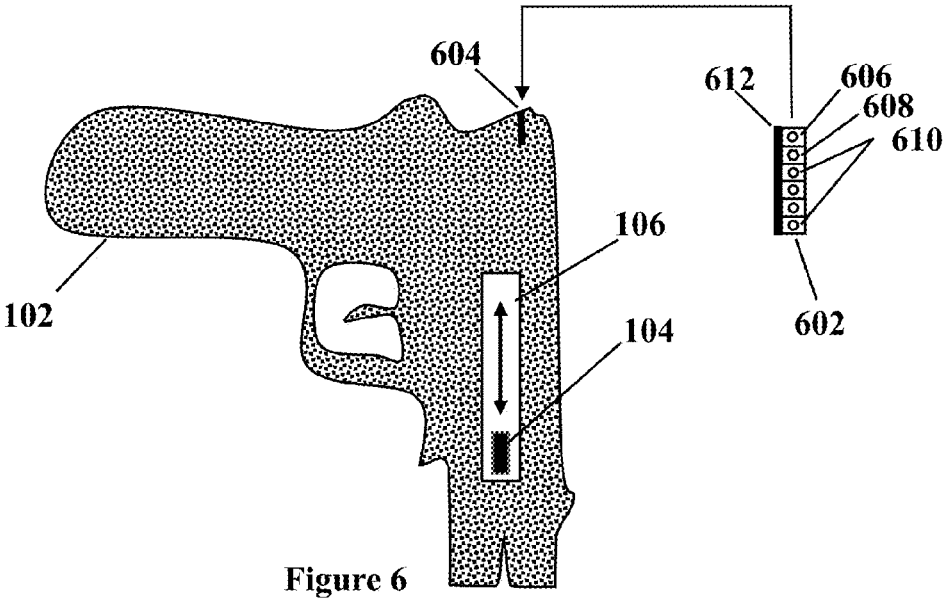
FIG. 6 shows a multi-mode and/or multi-ammunition weapon including a $2^{nd}$ embodiment for recording which form of attack mechanism was utilized for each shot fired of a sequence of shots, and wherein resetting of the recording function is under control of persons other than an assigned user of the weapon.

The multimode weapon of FIG. 5 may alternately comprise a recording function wherein for each shot fired, the recording function records which of the first and second modes (forms of attack mechanism/ammunition) are utilized for each shot fired of a sequence of shots, and wherein resetting of the recording function is under control of persons other than an assigned user of the weapon. One embodiment for such a configuration is shown in FIG. 6 wherein a cluster comprising a plurality of indicator positions 602 are shown on a removable strip or card that is insert-able in slot 604 on weapon 102. The removable strip or card includes a $1^{st}$ indicator position 606 that shows the type of ammunition/attack-mechanism fired for a first shot of a sequence of shots, a $2^{nd}$ indicator position 608 that shows the type of ammunition/attack-mechanism fired for a second shot of a sequence of shots, and subsequent indicator positions 610 that record and show in sequence types of attack mechanisms fired for each shot fired subsequent to 2nd shot 608. Cards or strips 602 are punched or depressed for each shot fired thus imparting a different physical shape at each indicator position to indicate the type of attack mechanism fired. Also shown is a serialized legend or watermark 612 that provides for resetting the recording function under control of persons other than an assigned user of the weapon by replacing card or strip 602 with a new/un-marked card or strip having a different a serialized legend or watermark 612. Persons who replace recording cards or strips would be authorized to do so under strict procedures to ensure that an accurate record is kept at all times. Optionally, a physical locking mechanism such as 508 may be used in conjunction with a replaceable strip or card 602.

Recording functionalities such as those shown in FIGS. 5 and 6 provide that via the plurality of indicator positions, each position may be configured to at least indicate:

i) that no shot has been fired;

ii) that the first form of attack mechanism was fired; and iii) that the second form of attack mechanism was fired.

While the weapon configurations of FIG. 1 through FIG. 6 are shown with two barrels, multimode weapons according to the invention may utilize a single barrel or a plurality of barrels, and may utilize projectile-type ammunition for both first and second modes, or alternately may utilize some form of electrical or chemical discharge attack mechanism for the first mode along with projectile-type ammunition for the second mode. An electrical discharge mechanism may include that type currently known as a Taser.

In order to ensure a high potential of deadly force, the second mode will typically include a conventional bullet-type ammunition projectile. For the first mode, one exemplary form of ammunition may be utilized that comprises a projectile cluster. Individual projectiles within the cluster may have a specific size and shape such that when penetrating the skin of a subject instantly causes an amount of discomfort that disables the subject. Alternately or combined with a specific size and shape, projectiles within a projectile cluster may include some form of chemical composition which assists in disabling a subject. Such a chemical composition may include various forms of sedative, and should the projectiles in the cluster penetrate a subject's skin and pierce one or more veins, the sedative would be carried within seconds to the subject's brain thus disabling the subject.

A form of ammunition comprising a projectile cluster may also include provision for controlling the spread (typical distance between projectiles) of projectiles at various distances from the weapon such that the projectiles acting together do not form too concentrated an impact on a subject which could inadvertently be deadly. Such a control for the spread of projectiles may be manually set by a user, and may also automatically default to a relatively widespread formation in order to minimize the probability of being deadly. A mechanism for controlling the spread of projectiles may further comprise an electronically controlled range finding mechanism to automatically determine the distance between the weapon and a subject currently in the line of fire, whereupon the spread of projectiles within the projectile cluster would be automatically controlled or set prior to firing, thereby providing a certain amount of spread upon reaching the distance where the subject is located. Essentially, this implements an electronically controlled variable choke mechanism. The electronically controlled range finding mechanism which controls the variable choke may comprise for example and without limitation a laser based, sonar-based, or radar-based range finding mechanism.

An attack mechanism consistent with the first mode may alternately be some form of dart, including some form of fast acting tranquilizer dart.

In general, where the attack mechanism consistent with the first mode fires a projectile or projectile cluster, the weapon may include a single shot provision for the first mode or alternately an ammunition storage magazine such that multiple shots may be fired consistent with the first mode. While the diagrams of FIG. 1 through FIG. 6 show a weapon with two barrels, any number of barrels may be utilized including a single barrel, two barrels as shown, or more than two barrels. Multiple attack mechanisms that utilize projectiles may share the same barrel, or alternately utilize different barrels.

An attack mechanism comprising the first mode for disabling a subject may also include a chemical discharge-type mechanism. A chemical discharge type mechanism may for example further comprise a projectile with a delayed deployment chemical dispersal mechanism wherein after being fired, the distance from the weapon apparatus whereupon the chemical is dispersed is set by an electronically controlled range finding mechanism that determines a distance from the weapon to a subject in the line of fire. Such an electronically controlled range finding mechanism may comprise for example and without limitation a laser based, sonar-based, or radar-based range finding mechanism.

The foregoing detailed description has set forth a few of the many forms that the invention can take. It is intended that the foregoing detailed description be understood as an illustration of selected forms that the invention can take and not as a limitation to the definition of the invention. It is only the claims, including all equivalents that are intended to define the scope of this invention.

At least certain principles of the invention can be implemented as hardware, firmware, software or any combination thereof. Moreover, the software is preferably implemented as an application program tangibly embodied on a program storage unit, a non-transitory user machine-readable medium, or a non-transitory machine-readable storage medium that can be in a form of a digital circuit, an analog circuit, a magnetic medium, or combination thereof. The application program may be uploaded to, and executed by, a machine comprising any suitable architecture. Preferably, the machine is implemented on a user machine platform having hardware such as one or more central processing units ("CPUs"), a memory, and input/output interfaces. The user machine platform may also include an operating system and microinstruction code. The various processes and functions described herein may be either part of the microinstruction code or part of the application program, or any combination thereof, which may be executed by a CPU, whether or not such user machine or processor is explicitly shown. In addition, various other peripheral units may be connected to the user machine platform such as an additional data storage unit and a printing unit.

What I claim is:

1. A pistol apparatus having at least two forms of attack mechanism including at least one firearm mechanism, comprising:

a first form of attack mechanism comprising other than a bullet-type firearm mechanism;

a second form of attack mechanism that is different from the first and comprises a bullet-type firearm mechanism;

a single, user-controllable integral selection mechanism that selects either the first or second form of attack mechanism;

a single trigger for activating whichever of the first or second attack mechanisms have been selected by the integral selection mechanism; and an integral recorder contained within the pistol apparatus wherein for each shot fired of a sequence of shots, the integral recorder records which of the first or second forms of attack mechanism are utilized for each shot fired of the sequence of shots.

2. The pistol apparatus of claim 1, wherein the integral recorder comprises a plurality of indicator positions, and wherein each indicator position is configured to indicate:

i) that no shot has been fired;

ii) that the first form of attack mechanism was fired; or iii) that the second form of attack mechanism was fired.

3. The pistol apparatus of claim 2, wherein the indicator positions are reset via a key mechanism to indicate after said resetting that no shots have been fired for all indicator positions.

4. The pistol apparatus of claim 2, wherein the indicator positions are located on a replaceable card or strip that is inserted into the pistol apparatus, and where each indicator position on the replaceable card or strip is either punched or depressed for each shot fired thus imparting a different physical shape at each indicator position to indicate that one of the following occurred:

i) the first form of attack mechanism was fired; or ii) the second form of attack mechanism was fired.

5. The pistol apparatus of claim 4, wherein the replaceable card or strip is uniquely marked for identification.

6. The pistol apparatus of claim 1 wherein the user-controlled integral selection mechanism comprises a slider mechanism.

7. The pistol apparatus of claim 1 wherein when first removed from a holster, the pistol apparatus is always initially in a first mode that utilizes the first form of attack mechanism; and wherein once removed from the holster, the pistol is easily placed by a user into a second mode that utilizes the second form of attack mechanism.

8. The pistol apparatus of claim 7 wherein placing the pistol apparatus into the holster automatically activates the integral selection mechanism to place the weapon into the first mode.

9. The pistol apparatus of claim 8 wherein a selection activation device within the holster engages with the integral selection mechanism to cause the pistol apparatus to be placed into the first mode when the pistol apparatus is placed in the holster.

10. The pistol apparatus of claim 9 wherein the integral selection mechanism comprises a slider mechanism that chooses between the first mode and the second mode.

11. The pistol apparatus of claim 10 wherein the slider mechanism physically engages with the selection activation device in the holster as the pistol apparatus is being placed in the holster, such that the slider mechanism causes the pistol apparatus to be placed in the first mode.

12. The pistol apparatus of claim 1 wherein the first form of attack mechanism comprises at least one of the following:

a projectile cluster;

a tranquilizer dart;

a chemical discharge; and an electrical discharge.

13. The pistol apparatus of claim 12, wherein projectiles within the projectile cluster further comprise a chemical composition capable of sedating or otherwise disabling a subject.

* * * * *